US007591230B2

(12) United States Patent
Kluge et al.

(10) Patent No.: US 7,591,230 B2
(45) Date of Patent: Sep. 22, 2009

(54) RUDDER FOR SHIPS

(75) Inventors: Mathias Kluge, Hamburg (DE); Henning Kuhlmann, Hamburg (DE)

(73) Assignee: becker marine systems GmbH & Co. KG, Hamburg (DE)

( * ) Notice: Subject to any disclaimer, the term of this patent is extended or adjusted under 35 U.S.C. 154(b) by 0 days.

(21) Appl. No.: 12/005,041

(22) Filed: Dec. 21, 2007

(65) Prior Publication Data

US 2009/0056610 A1 Mar. 5, 2009

(30) Foreign Application Priority Data

Sep. 5, 2007 (DE) ..... 20 2007 012 480 U

(51) Int. Cl.
*B63H 25/06* (2006.01)

(52) U.S. Cl. ..... 114/162; 114/165

(58) Field of Classification Search ..... 114/162, 114/163, 164, 165, 168, 169, 166, 167
See application file for complete search history.

(56) References Cited

U.S. PATENT DOCUMENTS 3,455,613 A 7/1969 McGrath
4,024,827 A * 5/1977 Becker ..... 114/162
4,284,025 A * 8/1981 Eckhard ..... 114/163
4,809,631 A 3/1989 Kramer
7,337,740 B2 * 3/2008 Lehmann et al. ..... 114/162
2007/0000423 A1 1/2007 Lehmann

FOREIGN PATENT DOCUMENTS

DE 1296542 5/1969
EP 0217295 4/1987
EP 1739008 1/2007

* cited by examiner

*Primary Examiner*—Lars A Olson
(74) *Attorney, Agent, or Firm*—Friedrich Kueffner

(57) ABSTRACT

In a rudder for ships composed of a rudder blade with a rudder post (40) held and supported in a rudder trunk (20), the rudder trunk (20) is made of a fiber composite material and is inserted into a nautical outer trunk tube (90) made of steel or of another appropriate material prepared by a shipyard, extending into the lower edge of the head box and inserted into the rudder blade (30). After alignment of the rudder trunk (20) in the nautical trunk tube (90), the intermediate space between both components (20, 90) is cast with a cast resin, or both components (20, 90) are bonded together.

18 Claims, 4 Drawing Sheets

RUDDER FOR SHIPS

BACKGROUND OF THE INVENTION

1. Field of the Invention

The present invention relates to a rudder for ships having a rudder blade with a rudder post supported in a rudder trunk.

2. Description of the Related Art

It is known to make the rudder trunk of a rudder system of wrought steel so that such rudder systems have high weights.

SUMMARY OF THE INVENTION

The object of this invention is to find for the rudder post an alternative material for the wrought steel. However, a sole material substitution for the rudder post can lead to difficulties in the whole system, for example, to exceeding maximally admissible bearing openings due to too great differences in the stiffness of the components rudder post and rudder trunk. For this reason, a material substitution is also provided for the rudder trunk in creating a rudder trunk with a low weight which has, in spite of a low weight, a high flexural strength and rigidity against torsion.

The above-described object is achieved in a rudder according to the type described above by making the rudder trunk of the rudder system consisting of the rudder blade, the rudder post and the rudder trunk of a fiber composite material and, after inserting and aligning, is cast or bonded in an outer nautical trunk tube prepared by the shipyard and extending to the lower edge of the head box.

The integration of the rudder trunk in fiber composite construction into the nautical steel structure is effected similarly as for a stern tube. The rudder trunk is inserted and aligned in an outer nautical trunk tube prepared by the shipyard which extends to the lower edge of the head box and is then cast or bonded. Detail solutions (for example inserting of tapered rings made of flexible materials) are to be found for the lower edge of the nautical trunk tube in order to reduce local tension concentrations in the trunk tube made of fiber composite material.

The following advantages are achieved with the configuration of the rudder trunk according to this invention. The main arguments for an alternative material for the wrought steel are the difficult procurement situation and the high costs for big cast parts. The use of fiber composite materials in relation with an effective method of production brings advantages as to the costs. The use of a rudder post made of fiber composite material also requires the substitution of the material for the rudder trunk. With fiber composite materials, clear weight advantages are to be achieved compared with wrought steel components. The inserting of the rudder trunk into the nautical structure prepared by the shipyard using an adhesive method brings technological advantages such as better alignment possibilities, the suppression of welded connections and welding delay.

Besides the configuration of the rudder trunk of a fiber composite material, according to a further embodiment of the invention, the rudder post of the rudder system is also made of a fiber composite material.

The fiber composite material is a carbon fiber composite material or of carbon fibers with an epoxy resin matrix or a glass fiber composite material with polyester resin matrix.

According to a further embodiment, the rudder post and/or the rudder trunk are manufactured according to the filament winding method.

The use of a rudder trunk and/or of a rudder post made of a fiber composite material is particularly advantageous for a rudder, the rudder trunk of which is provided as a projecting support with a central inner longitudinal bore for receiving the rudder post for the rudder blade and is configured reaching into the rudder blade connected with the rudder post end, wherein a bearing is placed in the inner longitudinal bore of the rudder trunk for bearing the rudder post, bearing which penetrates with its free end in a recess, taper or the like into the rudder blade, wherein the rudder post projects in its end area with a section out of the rudder trunk and is connected with the end of this section with the rudder blade, wherein the connection of the rudder post with the rudder blade is situated above the propeller shaft centre and wherein the inner bearing for the bearing of the rudder post is placed in the rudder trunk in the end area of the rudder trunk.

The high stability and flexural strength of the rudder trunk made of a fiber composite material allows placing the bearing for the rudder post in the end area of the rudder trunk, even if the rudder post should have a greater length. Only this bearing arrangement for the rudder post allows that the pressure forces acting onto the rudder blade of the rudder can be absorbed.

Furthermore, the rudder post can have end sections made of a non metallic material, in particular of wrought iron, and a central section made of a non metallic material connected with the end sections.

According to a further embodiment, the central section of the rudder post consisting of a non metallic material is made of a carbon fiber composite material or of carbon fibers, preferably of graphite fibers.

Both end sections of the rudder post made of wrought iron have, on their front sides turned to each other, neck-type reduced peg-shaped sections, the peripheral surfaces of which are provided with structures as adhesive surfaces for the central section made of carbon fibers which surround the peg-shaped sections as windings, wherein the carbon fibers are sheathed and lined with a cast resin in the whole winding area extending over the length of the central section.

Such a configuration of the rudder post brings the advantage that rudder posts with a big length, a big diameter and a high weight can be produced for rudders for water vehicles without the necessity of manufacturing the whole rudder post of wrought iron since only the end sections of the rudder post are produced of wrought iron, while the central section of the rudder post situated between the end sections is made of a non metallic material and in particular of a carbon fiber material or of carbon fibers, preferably of graphite fibers which form in the form of windings the central post section of the rudder post, wherein the windings of the carbon fiber composite material or the carbon fibers extend into the opposite ends of the end sections of the rudder post and are fixedly connected with them. In this manner, a rudder post is created, the end sections are made of wrought iron and can be subjected to the highest loads. Moreover, the end sections of the rudder post made of wrought iron take up the bearings for the bearing of the rudder post in a rudder trunk bearing.

End sections of wrought iron can be omitted when the whole rudder post is made for example of a carbon fiber composite material and is manufactured according to the filament winding method. For this configuration, neither the flexural strength nor the resistance to torsion are reduced.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
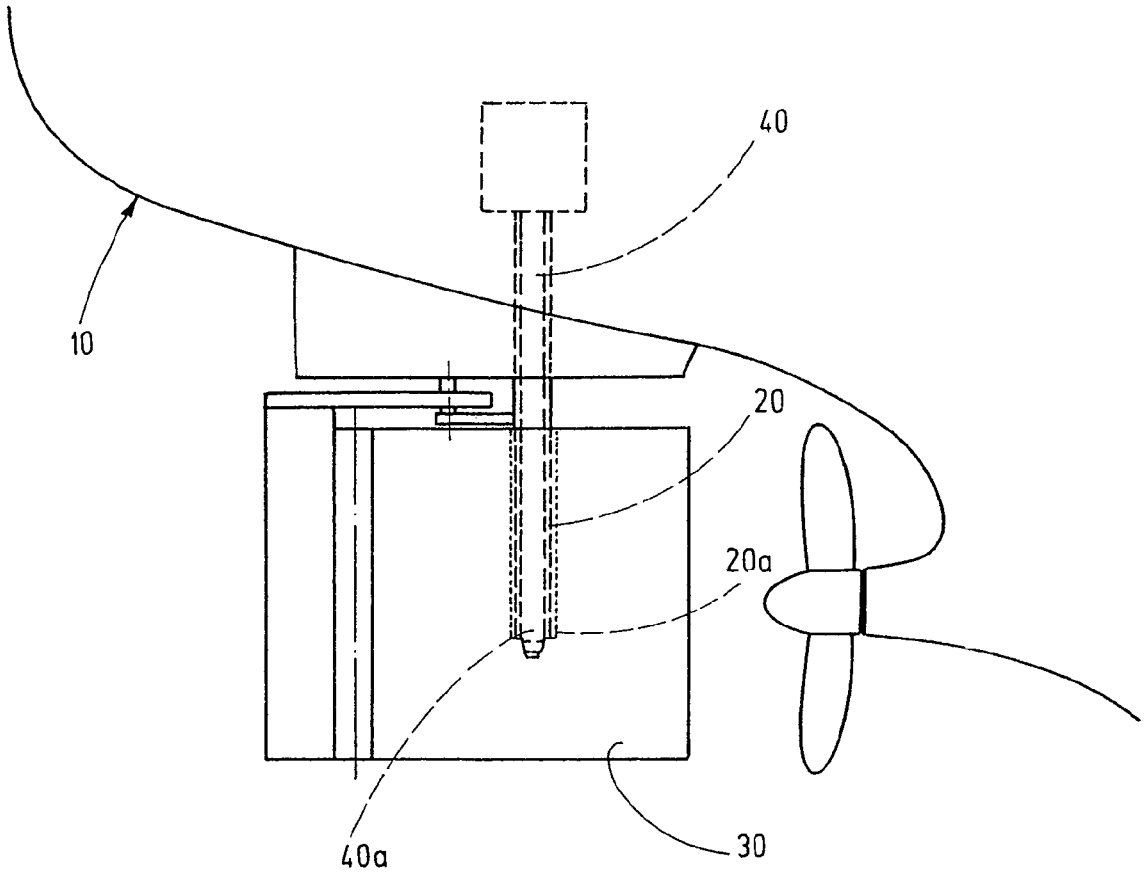
FIG. 1 is a side view of a rudder arrangement provided in the after body area with a rudder post placed in a rudder trunk.
Figure 4:
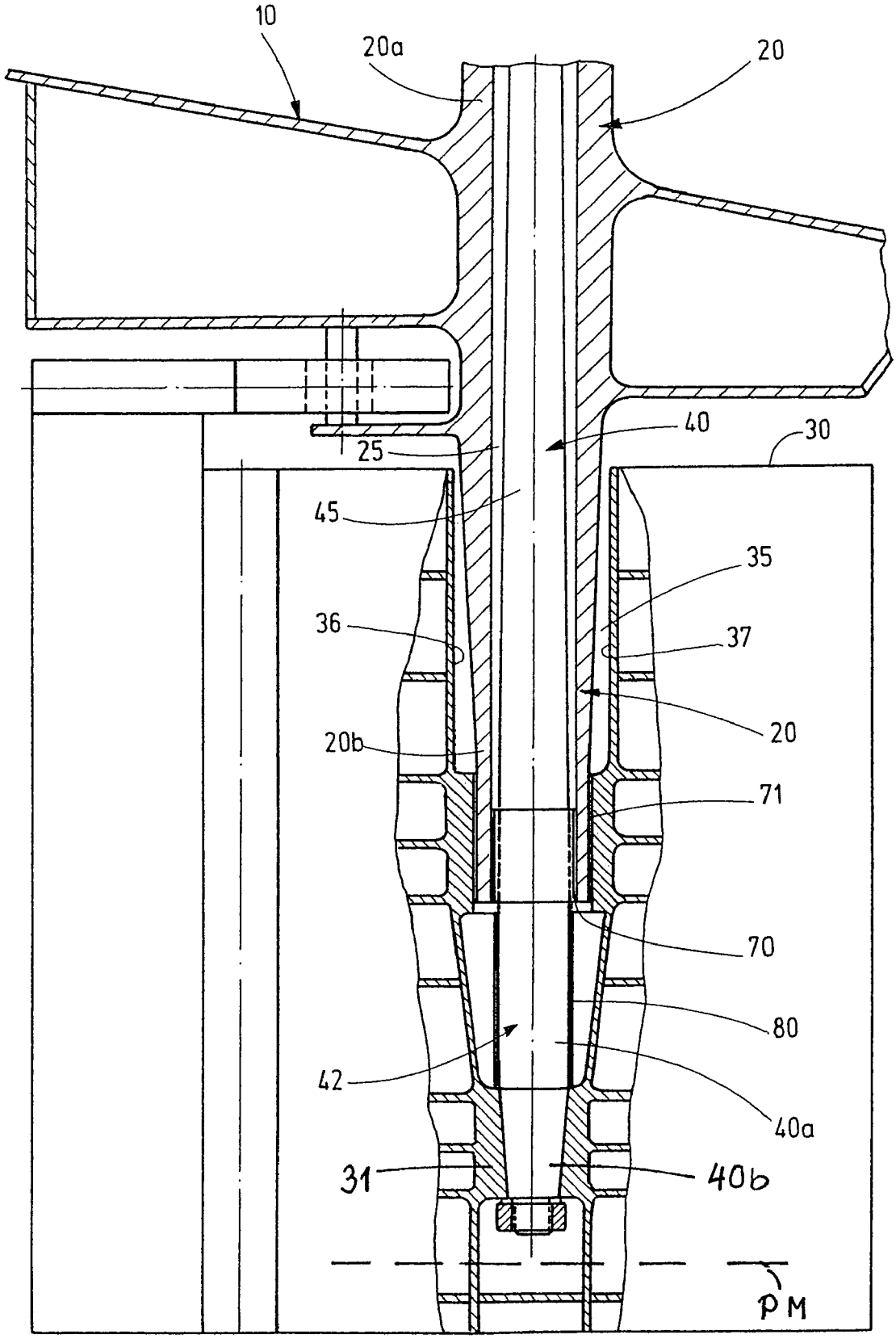
FIG. 4 shows partly in an elevational view and partly in a vertical sectional view the rudder system with the rudder post supported on one end side in the trunk tube and fixed on the rudder post.

For the embodiment of a rudder system for ships shown in FIGS. 1 and 4, 10 designates a hull, 20 a rudder trunk with its both ends 20*a*, 20*b*, 30 a rudder blade and 40 a rudder post.

The tube-type rudder trunk 20 configured as a projecting support is fixedly connected with its upper end 20*a* with the hull 10 and has an inner bore 25 which receives the rudder post 40. The rudder trunk 20 is guided into the rudder blade 30 which is fixedly connected with the free lower end 20*b* of the rudder post 40 which traverses the inner bore 25 of the rudder trunk bearing 20. The preferably cylindrical recess 35 which is configured in the rudder blade 30 for receiving the free end 20*b* of the rudder trunk 20 is limited by a lateral planking 36, 37 (FIG. 4).

The rudder trunk 20 is provided with a central inner longitudinal bore 25 for receiving the rudder post 40 for the rudder blade 30 and is configured reaching into the rudder blade 40 connected with the rudder post end, wherein at least one bearing 70 is placed in the inner longitudinal bore 25 for bearing the rudder post, this bearing reaching with its free end 40*a* into a recess, taper or the like into the rudder blade 30, wherein the rudder post 40 is guided in its end area 40*a* with a section 40*b* from the rudder trunk 20 and which is connected with the end of this section 40*b* with the rudder blade, wherein the connection of the rudder post 40 with the rudder blade 30 is situated above the propeller spindle middle PM. The inner bearing 70 for the bearing of the rudder post 40 is placed in the rudder trunk in the end area of the rudder trunk 20 (FIG. 4).

For the bearing of the rudder post 40, the rudder trunk 20 has at least one bearing. For the embodiment shown in FIG. 4, two bearings 70, 71 are provided, namely an inner bearing 70 and an outer bearing 71, wherein the bearing 70 is configured on the inner wall surface of the rudder trunk bearing 20 and the other bearing 71 on the outer wall surface of the rudder trunk or on the inner wall surface of the bearing provided on the rudder blade 30.

Figure 5:
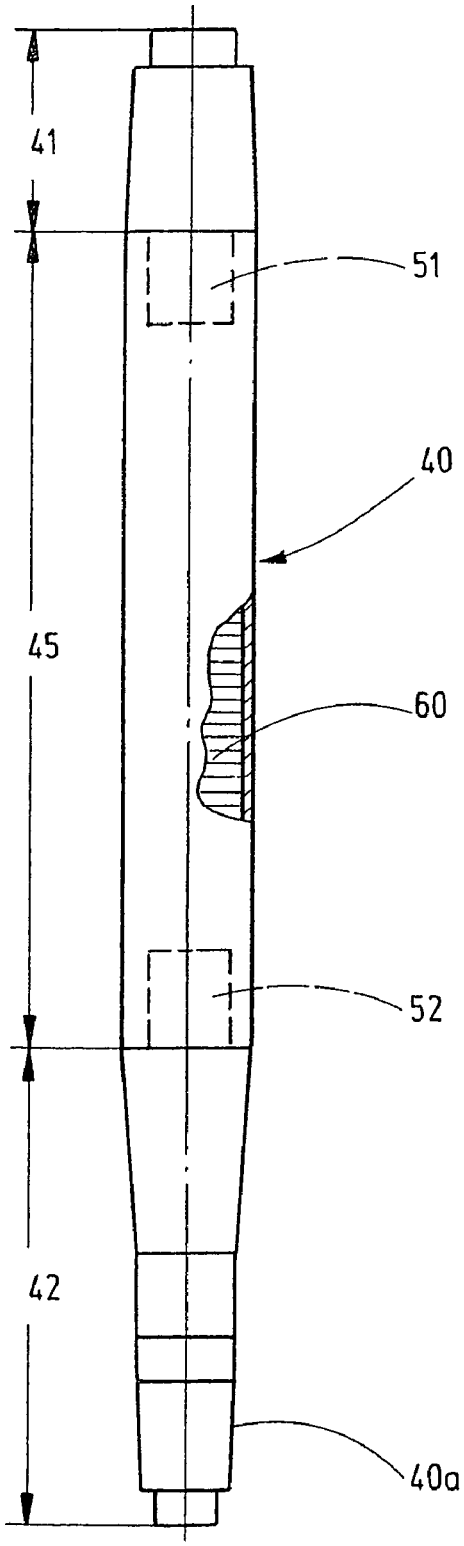
FIG. 5 is a view of the rudder post with end-sided sections made of wrought iron and with a central rudder shaft section made of a non metallic material.
Figure 6:
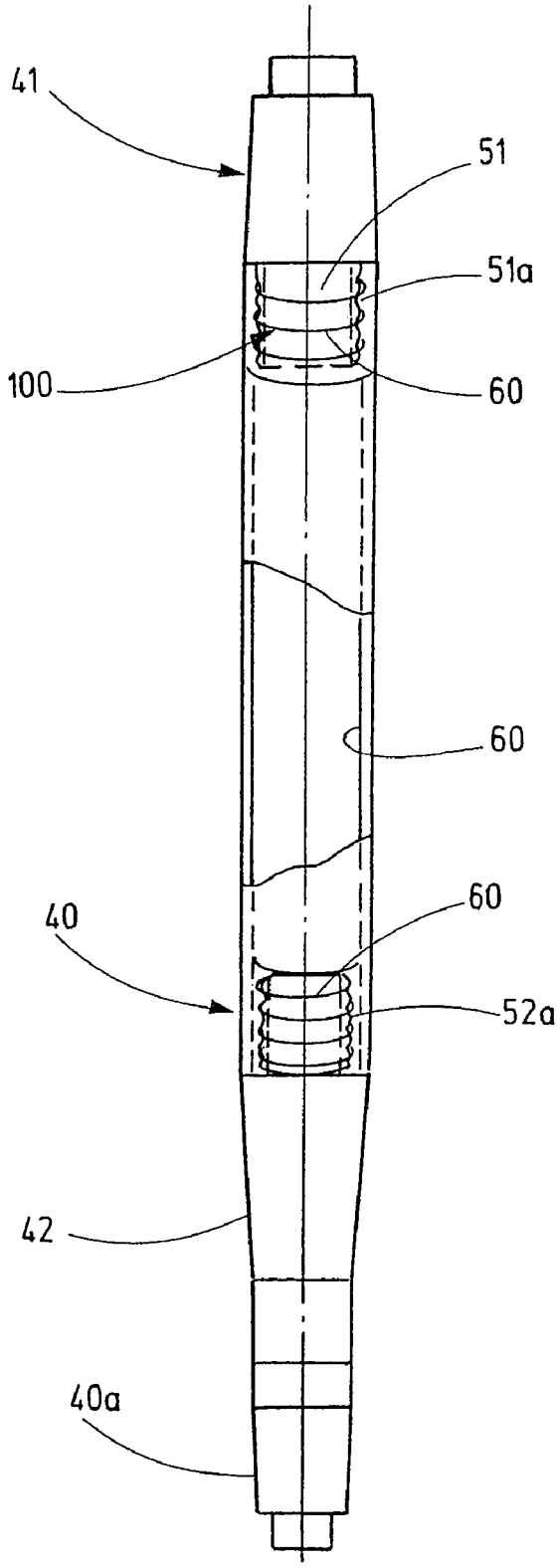
FIG. 6 is a view of a rudder post with end sections made of wrought iron and a central section made of wound carbon fibers connected with the end sections.

The rudder post 40 supported in the rudder trunk 20 is made of wrought iron or is preferably configured in such a manner that both its end sections 41, 42 are made of wrought iron, wherein the central post section 45 is made of a non metallic material, in particular of a carbon fiber composite material or of carbon fibers, preferably of graphite fibers with or without an epoxy resin matrix (FIG. 5). By wrought iron, we understand an iron with a carbon content situated under 0.8%. Advantageously, the rudder post 40 is produced according to the known filament winding system.

For the fixing of the central post section 45 of the rudder post 40, different construction configurations can be provided. As the embodiment according to FIG. 5 shows, the opposite front sides of both end sections 41, 42 have peg-shaped sections 51, 52 which are preferably with an outer wall structure 51*a*, 52*a* in order to guarantee the grip and the hold of the central post section 45 made of carbon fibers. Preferably, the carbon fibers or the carbon fiber composite material are fixed according to the filament winding system on the pegs 51, 52 of the end sections 41, 42, wherein the windings extend across the periphery of both pegs 51, 52 and over the whole length of the central post section 45. The carbon fibers are sheathed or cast with a cast resin for increasing the strength.

The configuration of the rudder post 20 is particularly preferred in so far as very big lengths of rudder posts can be produced for a lowest weight. For a rudder post having for example a length of 10 m, the weight is reduced by more than 50% with respect to a rudder post which is completely made of wrought iron.

A further embodiment provides that the rudder post 40 placed in the rudder trunk 20 has material reinforcements 80 in the area of the bearings 70, 71 placed in the rudder trunk 20, wherein preferably the material reinforcements 80 are provided in the area of the rudder trunk end 20*b*. These material reinforcements 80 are configured on the rudder post 40 preferably on the end section 42 of the rudder post 40 in the area of the inner bearing 70 provided on the rudder trunk 20 (FIG. 4).

Figure 2:
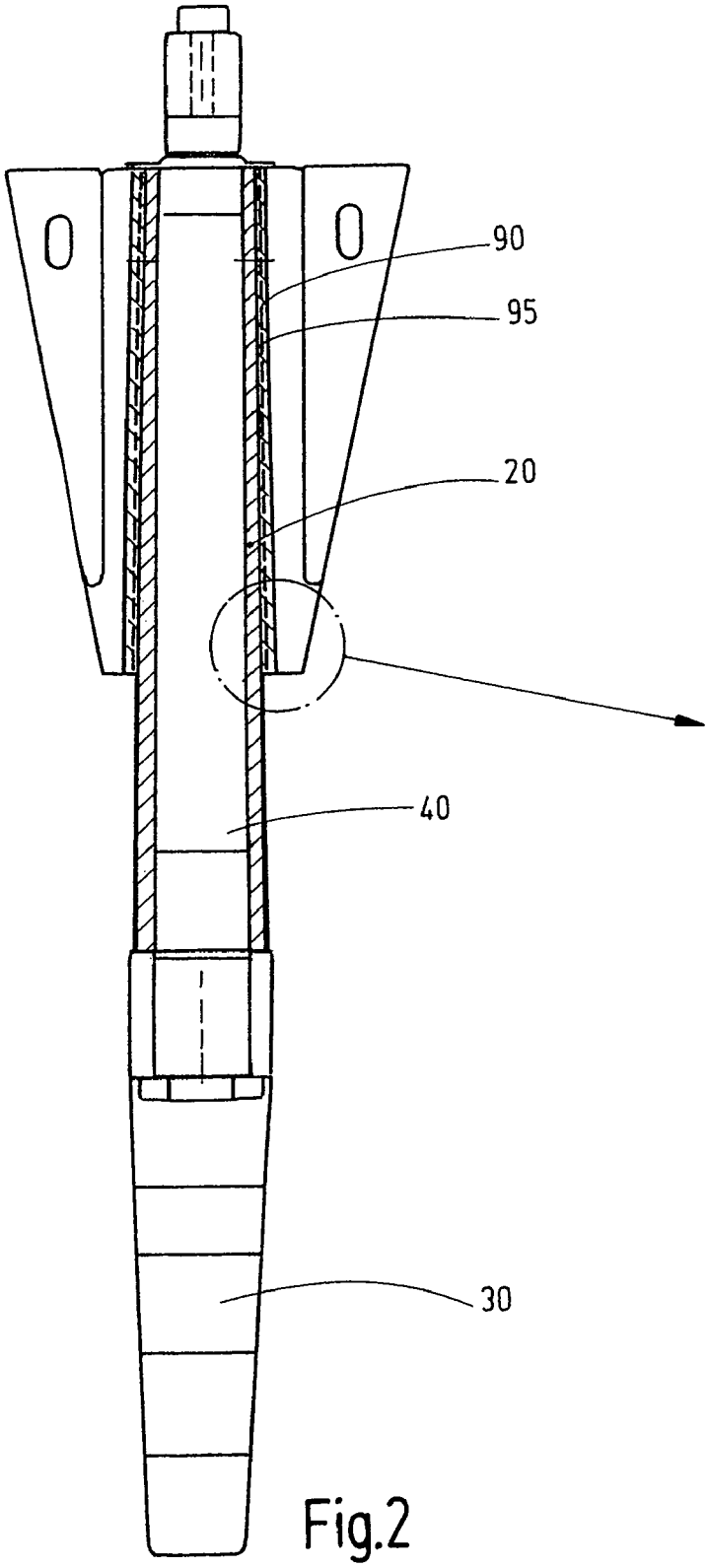
FIG. 2 shows partly in an elevational view and partly in a vertical sectional view a rudder system with the rudder trunk, the rudder post and the rudder blade.
Figure 3:
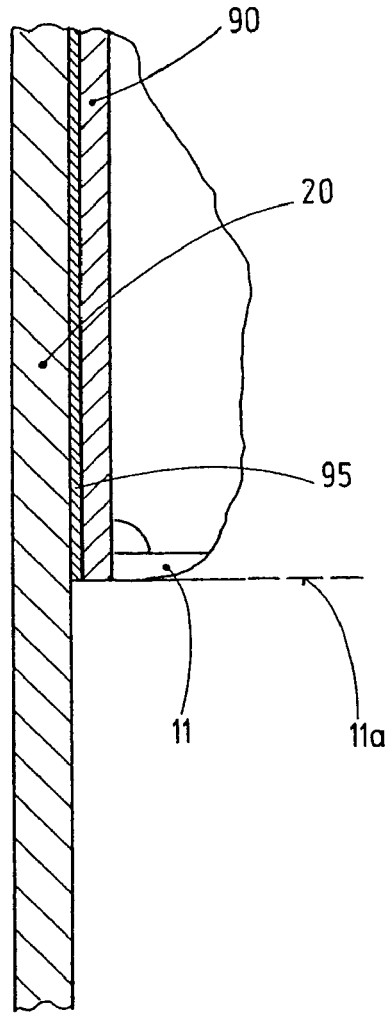
FIG. 3 shows an enlarged cutout A according to FIG. 2 with the rudder trunk reaching to the lower edge of the head box and inserted as well as cast or bonded in an outer trunk tube.

For the embodiment shown in FIGS. 2 and 3, the rudder trunk 20 is made of a fiber composite material 100 and is inserted into a nautical outer trunk tube 90 made of steel or of another appropriate material prepared by the shipyard, reaching into the lower edge 11*a* of the head box 11 and inserted into the rudder blade, wherein, after alignment of the rudder trunk 20 in the nautical trunk tube 90 the intermediate space formed between both components 20, 90 is cast with a cast resin, or both components 20, 90 are bonded together.

Due to the fact that the rudder trunk 20 is connected with the trunk tube 90 because of the bonding or the use of cast resins, a firm compound is obtained between both components so that thin-walled materials can be used for the tube-type rudder trunk and the trunk tube which moreover results in a saving of weight which is particularly important when the matter is of bigger rudder installations.

The integration of the rudder trunk 20 in fiber composite material into the nautical steel structure, i.e. into the rudder blade 30, takes place similarly as for the stern tube of a ship. The rudder trunk 20 is inserted into an outer nautical trunk tube 90 of steel or of another appropriate material, prepared by the shipyard, which reaches to the lower edge 11*a* of the head box 11. This nautical trunk tube 90 is inserted and fixed in the rudder blade 30. The rudder trunk 20 made of the fiber composite material is then aligned in the nautical trunk tube 90. The intermediate space between the nautical trunk tube 90 and the rudder trunk 20 is then cast for example with a cast resin 95 or both components are bonded together so that a firm connection is created between the nautical trunk tube 90 and the rudder trunk 20 (FIG. 3). The rudder post 40 is then inserted into the system configured in this manner into the rudder trunk 20 and is supported in the rudder blade 30 and fixed at the ends with the rudder blade. Detail solutions, for example placing of tapered rings made of flexible materials, are possible for the lower edge of the nautical trunk tube in order to reduce here local tension concentrations in the trunk tube 20 made of fiber composite material.

The fiber composite material for producing the rudder trunk 20 and/or of the rudder post 40 is a carbon fiber composite material or of carbon fibers of an epoxy resin matrix or a glass fiber composite material with polyester resin matrix.

The rudder post 40 as well as the rudder trunk 20 are produced according to the filament winding system.

Fiber composite materials have essential advantages compared with wrought steel since the carbon fiber materials with epoxy resin matrix compared with glass fiber materials with polyester resin matrix have the better material properties with respect to rigidity, resistance and firmness and however result in higher material costs. However, the selection of materials for the rudder trunk should take place only in connection with the dimensioning of the rudder post in order to achieve an adaptation of the structure rigidity of both components rudder trunk and rudder post.

The main argument for an alternative material such as a fiber composite material for the wrought steel are the difficult procurement situation and the high costs for big cast parts. The use of fiber composite materials in relation with an effective method of production brings advantages as to the costs.

With fiber composite materials, clear weight advantages are to be achieved compared with wrought steel components.

The inserting of the rudder trunk 20 by a bonding method or casting method into the nautical structure prepared by the shipyard brings technological advantages such as better alignment possibilities, suppression of welded connections and welding delay.

If fiber composite materials with the properties of wrought iron are used for the rudder trunk 20, a rudder trunk 20 configured in such a manner can also be used without intercalating a trunk tube 90 of steel.

Furthermore, the invention comprises a method for manufacturing a rudder trunk 20 which receives the rudder post 40 and which is inserted in a rudder blade 30 of the rudder for ships, wherein a nautical outer trunk tube 90 of steel or of another appropriate material is used and fixed in the rudder blade 30, a rudder trunk 20 made of a fiber composite material is then inserted into the nautical trunk tube 90 and is aligned in the trunk tube 90, after which the intermediate space between the rudder trunk 20 and the trunk tube 90 is filled with a cast resin 95 or both components 20, 90 are bonded together. The nautical trunk tube 90 is preferably inserted by reaching to the lower edge 11*a* of the head box 11 of the rudder blade 30.

While specific embodiments of the invention have been described in detail to illustrate the inventive principles, it will be understood that the invention may be embodied otherwise without departing from such principles.

We claim:

1. A rudder for ships comprising a rudder blade (30) with a rudder post (40) held and supported in a rudder trunk (20), wherein the rudder trunk (20) is of a fiber composite material (100) and is inserted into a nautical outer trunk tube (90) of steel or of another material, reaching into the lower edge (11*a*) of a head box (11) and inserted in the rudder blade (30), wherein, after alignment of the rudder trunk (20) in the nautical trunk tube (90) an intermediate space formed between both components (20, 90) is cast with a cast resin (95) or both components (20, 90) are bonded together.

2. The rudder according to claim 1, wherein the rudder post (40) is of a fiber composite material (100).

3. The rudder according to claim 1, wherein the fiber composite material (100) is a carbon fiber composite material or is made of carbon fibers with an epoxy resin matrix.

4. The rudder according to claim 3, wherein the fiber composite material is a glass fiber composite material with polyester resin matrix.

5. The rudder according to claim 1, wherein the rudder post (40) and/or the rudder trunk (20) are manufactured by a filament winding method.

6. The rudder according to claim 1, wherein the rudder post (40) has end sections (41, 42) of a non metallic material, and a central post section (45) of a non metallic material connected with the end sections (41, 42).

7. The rudder according to claim 6, wherein the non-metallic material is wrought iron.

8. The rudder according to claim 1, wherein the central post section (45) of the rudder post (40) composed of a non metallic material is of a carbon fiber composite material or of carbon fibers.

9. The rudder according to claim 8, wherein the carbon fibers are graphite fibers.

10. The rudder according to claim 6, wherein both end sections (41, 42) of the rudder post (40) made of wrought iron have, on their front sides turned to each other, neck-type reduced peg-shaped sections (51, 52), the peripheral surfaces of which are provided with structures (51*a*, 52*a*) as adhesive surfaces for the central section (45) made of carbon fibers which surround the peg-shaped sections (51, 52) as windings (60), wherein the carbon fibers are sheathed and lined with a cast resin in an entire winding area extending over the length of the central section (45).

11. The rudder according to claim 6, wherein the ratio of the length of the end sections (41, 42) and of the central post section (45) of the rudder post (40) is 1/6 to 2/3 to 1/6.

12. The rudder according to claim 6, wherein the rudder post (40) has material reinforcements in an area of the bearings (70, 71) placed in the rudder trunk bearing (20).

13. The rudder according to claim 12, wherein the material reinforcements (80) are provided in the area of a rudder trunk bearing end (20*b*).

14. The rudder post according to claim 10, wherein the material reinforcements (80) are configured in an area of the inner bearing (70) provided on the rudder trunk bearing (20).

15. The rudder according to claim 1, wherein the rudder trunk (20) as a projecting support is provided with a central inner longitudinal bore (25) for receiving the rudder post (40) for the rudder blade (30) and is configured to reach into the rudder blade (30) connected with the rudder post end, wherein at least one bearing (70) is placed in the inner longitudinal bore (25) of the rudder trunk (20) for bearing the rudder post (40), bearing which penetrates with its free end (40*a*) in a recess or taper (31) in the rudder blade (30), wherein the rudder post (40) projects in its end area (40*a*) with a section (40*b*) out of the rudder trunk (20) and is connected with the end of this section (40*b*) to the rudder blade (30), wherein the inner bearing (70) for the bearing of the rudder post (40) is placed in the rudder trunk (20) in the end area of the rudder trunk (20).

16. The method according to claim 15, wherein the connection of the rudder post (40) with the rudder blade (30) is situated above a propeller shaft center (PM).

17. A method of manufacturing a rudder trunk (20) which receives the rudder post (40) and which is placed in a rudder blade (30) of the rudder for ships, the method comprising using a nautical outer trunk tube (90) of steel or of another material and fixing the outer trunk tube in the rudder blade (30), then inserting a rudder trunk (20) of a fiber composite material into the nautical trunk tube (90) and aligning the rudder trunk in the trunk tube (90), and subsequently filling an intermediate space between the rudder trunk (20) and the trunk tube (90) with a cast resin (95), or bonding both components (20, 90) together.

18. The method according to claim 17, comprising inserting the nautical trunk tube (90) reaching to the lower edge (11*a*) of the head box (11) of the rudder blade (30).

* * * * *